US011460228B2

(12) United States Patent
Nagata et al.

(10) Patent No.: US 11,460,228 B2
(45) Date of Patent: Oct. 4, 2022

(54) HEAT EXCHANGER, OUTDOOR UNIT AND REFRIGERATION CYCLE APPARATUS

(71) Applicant: Mitsubishi Electric Corporation, Tokyo (JP)

(72) Inventors: Ryuichi Nagata, Tokyo (JP); Tsuyoshi Maeda, Tokyo (JP); Shin Nakamura, Tokyo (JP); Akira Ishibashi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 161 days.

(21) Appl. No.: 16/955,892

(22) PCT Filed: Jan. 18, 2018

(86) PCT No.: PCT/JP2018/001429
§ 371 (c)(1),
(2) Date: Jun. 19, 2020

(87) PCT Pub. No.: WO2019/142296
PCT Pub. Date: Jul. 25, 2019

(65) Prior Publication Data

US 2021/0018232 A1 Jan. 21, 2021

(51) Int. Cl.
*F25B 1/00* (2006.01)
*F25B 39/02* (2006.01)
(Continued)

(52) U.S. Cl.
CPC ..... *F25B 39/02* (2013.01); *F28F 9/02* (2013.01); *F25B 2313/02741* (2013.01); *F28D 2021/0068* (2013.01); *F28F 2215/12* (2013.01)

(58) Field of Classification Search
CPC ..... F25B 39/02; F25B 39/00; F25B 2313/02741; F25B 41/42; F25B 41/00;
(Continued)

(56) References Cited

U.S. PATENT DOCUMENTS

2013/0306285 A1* 11/2013 Jindou ..... F28F 9/02 165/173
2016/0187049 A1 6/2016 Hokazono et al.
(Continued)

FOREIGN PATENT DOCUMENTS

JP 2001-066017 A 3/2001
JP 2008-261552 A 10/2008
(Continued)

OTHER PUBLICATIONS

Extended European Search Report dated Nov. 11, 2020 issued in corresponding EP application No. 18901369.1 (and English translation).
(Continued)

*Primary Examiner* — Henry T Crenshaw
*Assistant Examiner* — Kamran Tavakoldavani
(74) *Attorney, Agent, or Firm* — Posz Law Group, PLC

(57) ABSTRACT

An outdoor heat exchanger includes: a main heat exchange area; a sub heat exchange area; and a connecting pipe and a connecting pipe interconnecting the main heat exchange area and the sub heat exchange area. The main heat exchange area has a main heat exchange channel and a main heat exchange channel. The sub heat exchange area has a sub heat exchange channel, a sub heat exchange channel, and a sub heat exchange channel. The connecting pipe connects the sub heat exchange channel and the sub heat exchange channel to the main heat exchange channel while the sub heat exchange channels are joined together. The connecting pipe interconnects the sub heat exchange channel and the main heat exchange channel.

9 Claims, 15 Drawing Sheets

(51) Int. Cl.
*F28F 9/02* (2006.01)
*F28D 21/00* (2006.01)

(58) Field of Classification Search
CPC ..... F25B 2339/02; F25B 2339/04; F28F 9/02; F28F 2215/12; F28D 2021/0068; F28D 1/05391; F28D 1/0408; F28D 1/0435; F28D 1/0443; F28D 1/0452
See application file for complete search history.

(56) References Cited

U.S. PATENT DOCUMENTS

| | | | | |
|---|---|---|---|---|
| 2016/0216014 | A1* | 7/2016 | Morimoto ..... | F28F 9/0265 |
| 2016/0348951 | A1 | 12/2016 | Matsumura et al. | |

FOREIGN PATENT DOCUMENTS

| | | | |
|---|---|---|---|
| JP | 2008-286488 | A | 11/2008 |
| JP | 2012-163328 | A | 8/2012 |
| JP | 2016-223672 | A | 12/2016 |
| JP | 6213543 | B2 | 10/2017 |
| WO | 2014/199501 | A1 | 12/2014 |
| WO | 2015/111220 | A1 | 7/2015 |

OTHER PUBLICATIONS

Indian Office Action dated Apr. 12, 2021, issued in corresponding Indian Patent Application No. 202027026577 (and English Machine Translation).
Australian Office Action dated Feb. 18, 2021, issued in corresponding Australian Patent Application No. 2018402660.
Korean Office Action dated Jun. 18, 2021, issued in corresponding KR Patent Application No. 10-2020-7019829 (and English Machine Translation).
International Search Report of the International Searching Authority dated Mar. 13, 2018 for the corresponding International application No. PCT/JP2018/001429 (and English translation).
Japanese Office Action dated Feb. 16, 2021, issued in corresponding Japanese Patent Application No. 2019-565634 (and English Machine Translation).
Chinese Office Action dated May 26, 2021, issued in corresponding Chinese Patent Application No. 201880086346. 4 (and English Machine Translation).
Korean Office Action dated Dec. 9, 2021, issued in corresponding KR Patent Application No. 10-2020-7019829 (and English machine translation).

* cited by examiner

HEAT EXCHANGER, OUTDOOR UNIT AND REFRIGERATION CYCLE APPARATUS

CROSS REFERENCE TO RELATED APPLICATION

This application is a U.S. national stage application of PCT/JP2018/001429 filed on Jan. 18, 2018, the contents of which are incorporated herein by reference.

TECHNICAL FIELD

The present invention relates to a heat exchanger, an outdoor unit and a refrigeration cycle apparatus, and particularly to a heat exchanger including a main heat exchange area and a sub heat exchange area, an outdoor unit including the heat exchanger, and a refrigeration cycle apparatus including the outdoor unit.

BACKGROUND ART

An air conditioner as a refrigeration cycle apparatus includes a refrigerant circuit including an indoor unit and an outdoor unit. Such an air conditioner can perform a cooling operation and a heating operation by switching a channel of the refrigerant circuit by using a four-way valve or the like.

The indoor unit is provided with an indoor heat exchanger. The indoor heat exchanger exchanges heat between refrigerant flowing through the refrigerant circuit and indoor air sent by an indoor blower. The outdoor unit is provided with an outdoor heat exchanger. The outdoor heat exchanger exchanges heat between refrigerant flowing through the refrigerant circuit and external air sent by an outdoor blower.

One such outdoor heat exchanger used in the air conditioner is an outdoor heat exchanger having a heat transfer tube disposed to penetrate a plurality of plate-shaped fins. Such an outdoor heat exchanger is referred to as a fin-and-tube heat exchanger.

Furthermore, for this type of outdoor heat exchanger, there is a type including a two-phase main heat exchange area and a single-phase sub heat exchange area. When the air conditioner is operated in the cooling mode, the outdoor heat exchanger functions as a condenser. The outdoor heat exchanger receives refrigerant, which in turn exchanges heat with air while flowing through the main heat exchange area, and is thus condensed into a liquid refrigerant. After flowing through the main heat exchange area, the liquid refrigerant will further be cooled by flowing through the sub heat exchange area. Note that when refrigerant flows through such a channel, a refrigerant path only passing the liquid refrigerant has a lower intra-tube heat transfer ratio than a refrigerant path passing a two-phase refrigerant (i.e., liquid and gas), which leads to impairing the heat exchanger in performance. Accordingly, the main heat exchange area has an outlet provided with a joining section to join refrigerant paths. The liquid refrigerant joins at the joining section and then flows into the sub heat exchange area. This increases the liquid refrigerant's intra-tube heat transfer ratio. This enhances performance as a heat exchanger.

In contrast, when the air conditioner is operated in the heating mode, the outdoor heat exchanger functions as an evaporator. The outdoor heat exchanger receives refrigerant, which in turn exchanges heat with air while flowing from the sub heat exchange area and passing through the main heat exchange area, and thus evaporates to become a gas refrigerant. When the outdoor heat exchanger functions as an evaporator, the outlet of the main heat exchange area as the condenser serves an inlet of the main heat exchange area as the evaporator. Therefore, the number of branches of the channel from the sub heat exchange area to the main heat exchange area is increased by the joining section. That is, the joining section functions as a re-branching distributor. Note that an air conditioner including this type of outdoor heat exchanger is disclosed for example in PTL 1.

CITATION LIST

Patent Literature

PTL 1: WO2015/111220

SUMMARY OF INVENTION

Technical Problem

When the outdoor heat exchanger disclosed in PTL1 functions as an evaporator, the number of refrigerant paths at the inlet of the main heat exchange area does not match the number of refrigerant paths at the outlet of the sub heat exchange area. Therefore, the inlet of the main heat exchange area and the outlet of the sub heat exchange area cannot be connected together directly. Accordingly, as shown in FIG. 9 of PTL1, a re-branching distributor (distributor) is installed between the main heat exchange area and the sub heat exchange area. The re-branching distributor is provided at a connecting pipe that connects the outlet of the sub heat exchange area and the inlet of the main heat exchange area. The re-branching distributor integrates all of the refrigerant paths of the sub heat exchange area into one path and then re-branches the path. However, the re-branching distributor has a large pressure loss due to collision of refrigerant, resulting in deterioration in performance as a heat exchanger (more specifically, in heating performance).

Furthermore, the connecting pipe that integrates all of the refrigerant paths of the sub heat exchange area passes the refrigerant at a large flow rate and hence has a large pressure loss. This results in deterioration in performance as a heat exchanger (more specifically, in heating performance).

The outdoor heat exchanger disclosed in PTL1 thus provides impaired performance as a heat exchanger due to an increase in pressure loss caused by re-branching a refrigerant path of the sub heat exchange area and integrating the re-branched refrigerant path.

The present invention has been made in view of the above problem, and an object thereof is to provide a heat exchanger, an outdoor unit, and a refrigeration cycle apparatus that can suppress deterioration of performance as a heat exchanger due to an increase in pressure loss.

Solution to Problem

A heat exchanger according to the present invention includes a main heat exchange area, a sub heat exchange area, and a first connecting pipe and a second connecting pipe configured to interconnect the main heat exchange area and the sub heat exchange area. The main heat exchange area has a first main heat exchange channel and a second main heat exchange channel. The sub heat exchange area has a first sub heat exchange channel, a second sub heat exchange channel, and a third sub heat exchange channel. The first connecting pipe connects the first and second sub heat exchange channels to the first main heat exchange channel while the first and second sub heat exchange channels are joined together. The second connecting pipe connects the third sub heat exchange channel and the second main heat exchange channel together.

Advantageous Effects of Invention

According to the heat exchanger of the present invention, the first connecting pipe connects the first and second sub heat exchange channels to the first main heat exchange channel while the first and second sub heat exchange channels are joined together. Thus the first connecting pipe connects the first and second sub heat exchange channels to the first main heat exchange channel without re-branching the first and second sub heat exchange channels. This can suppress an increase in pressure loss inside the first connecting pipe. Furthermore, the first connecting pipe and the second connecting pipe interconnect the main heat exchange area and the sub heat exchange area. This dispenses with integrating all of the refrigerant paths of the sub heat exchange area into one connecting pipe. This allows refrigerant's flow rate to be divided into the first connecting pipe and the second connecting pipe and can thus suppress an increase in pressure loss inside the first connecting pipe and the second connecting pipe. This can suppress deterioration in performance as a heat exchanger.

DESCRIPTION OF EMBODIMENTS

Hereinafter reference will be made to the drawings to describe the present invention in embodiments. In each of the following embodiments, an air conditioner will be described as an example of a refrigeration cycle apparatus. Furthermore, an example will be described in which the claimed heat exchanger is applied to an outdoor heat exchanger. The claimed heat exchanger may be applied to an indoor heat exchanger. Furthermore, an example will be described in which the claimed blower is applied to an outdoor heat exchanger. The claimed blower may be applied to an indoor blower.

First Embodiment

Figure 1:
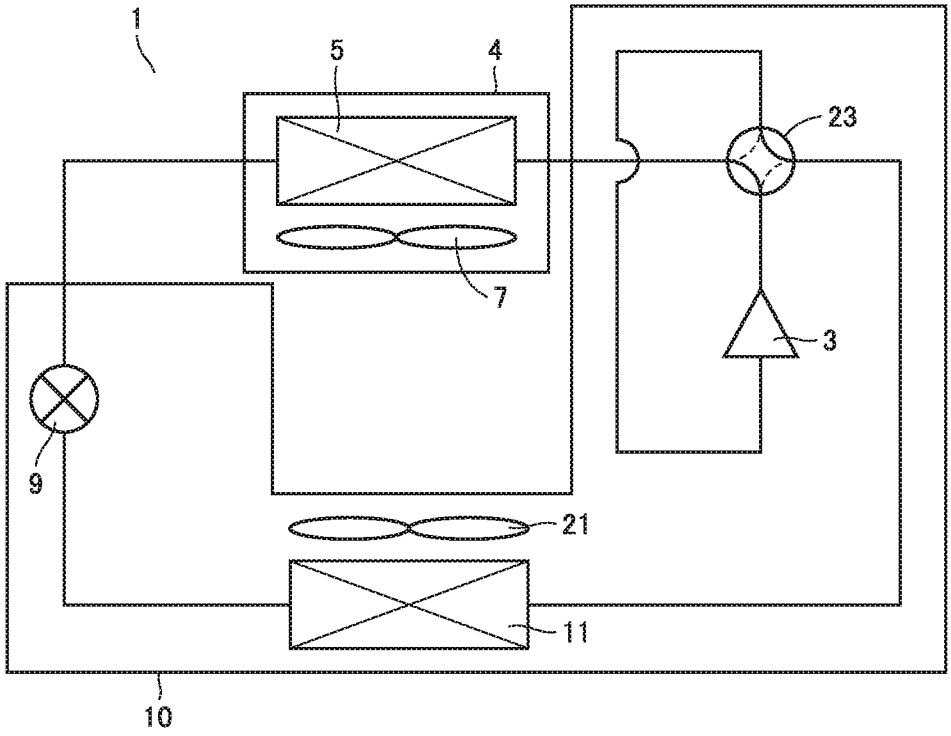
FIG. 1 is a diagram showing an example of a refrigerant circuit of an air conditioner according to a first embodiment.

Initially, reference will be made to FIG. 1 to describe how an air conditioner 1 as a refrigeration cycle apparatus according to a first embodiment of the present invention (a refrigerant circuit) is generally configured. As shown in FIG. 1, air conditioner 1 includes a compressor 3, an indoor heat exchanger 5, an indoor blower 7, a throttling device 9, an outdoor heat exchanger 11, an outdoor blower 21 and a four-way valve 23. Compressor 3, indoor heat exchanger 5, throttling device 9, outdoor heat exchanger 11 and four-way valve 23 are connected by a refrigerant pipe.

Indoor heat exchanger 5 and indoor blower 7 are disposed in indoor unit 4. Outdoor heat exchanger 11 and outdoor blower 21 are disposed in outdoor unit 10. Furthermore, compressor 3, throttling device 9, and four-way valve 23 are also disposed in outdoor unit 10.

Reference will now be made to FIGS. 1 to 6 to describe outdoor heat exchanger (a heat exchanger) 11 of outdoor unit 10 according to the first embodiment.

Figure 2:
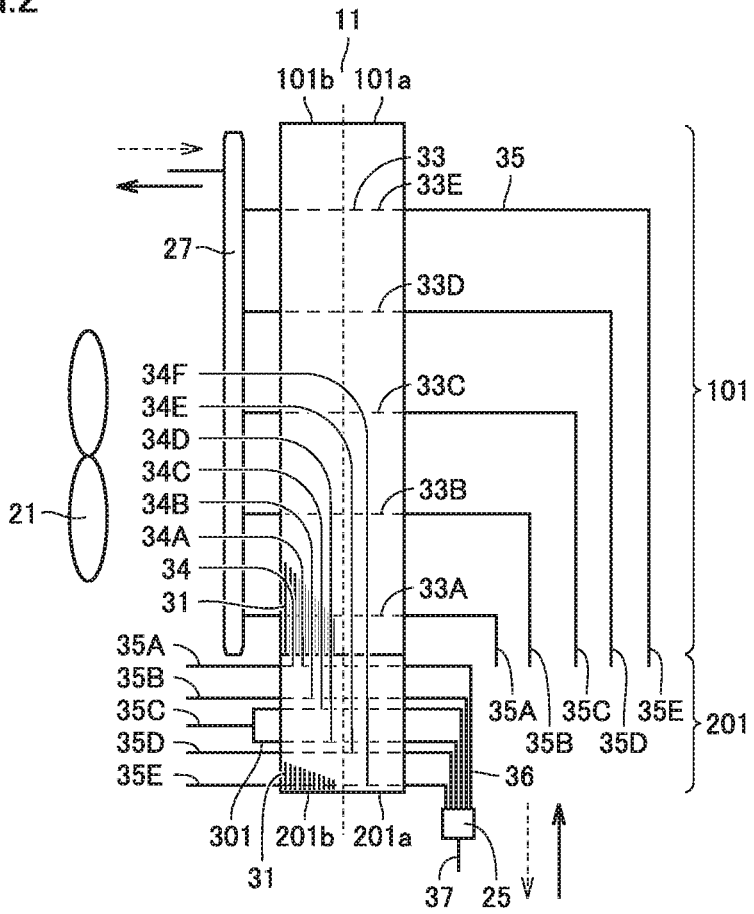
FIG. 2 is a schematic diagram showing an outdoor heat exchanger according to the first embodiment.

As shown in FIG. 2, outdoor heat exchanger 11 includes a main heat exchange area 101, a sub heat exchange area 201, and a plurality of connecting pipes 35. The plurality of connecting pipes 35 interconnect main heat exchange area 101 and sub heat exchange area 201. Each of the plurality of connecting pipes 35 is, for example, a round pipe having a circular cross-sectional shape. In the present embodiment, sub heat exchange area 201 is disposed below main heat exchange area 101.

Main heat exchange area 101 has a main heat exchange area 101*a* disposed in a first row and a main heat exchange area 101*b* disposed in a second row. Sub heat exchange area 201 has a sub heat exchange area 201*a* disposed in the first row and a sub heat exchange area 201*b* disposed in the second row. At least one of the plurality of connecting pipes 35 has a joining path 301 disposed at the outlet of sub heat exchange area 201.

Main heat exchange area 101 has a plurality of heat transfer tubes 33 disposed to penetrate a plurality of plate-shaped fins 31. Sub heat exchange area 201 has a plurality of heat transfer tubes 34 disposed to penetrate the plurality of plate-shaped fins 31. The plurality of heat transfer tubes 33, 34 form a refrigerant path. In the present embodiment, main heat exchange area 101 has a plurality of main heat exchange channels 33A to 33E as a refrigerant path. That is, five main heat exchange channels 33A to 33E are formed in main heat exchange area 101. Furthermore, sub heat exchange area 201 has a plurality of sub heat exchange channels 34A to 34F as a refrigerant path. That is, six sub heat exchange channels 34A to 34F are formed in sub heat exchange area 201.

Each of heat transfer tubes 33 and 34 is, for example, a flat tube having a flat cross section having a major axis and a minor axis. Each of heat transfer tubes 33 and 34 may for example be a circular tube having a circular cross section or an elliptical tube having an elliptical cross section.

Figure 3:
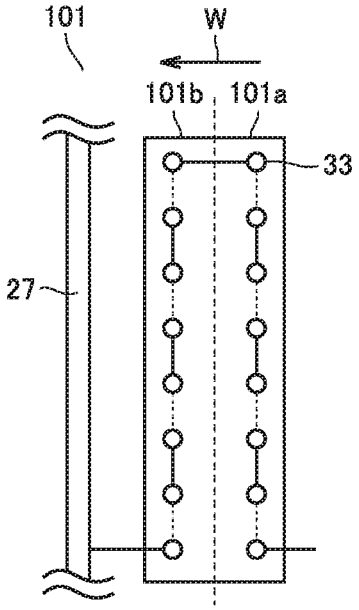
FIG. 3 is a schematic side view showing a main heat exchange area of the outdoor heat exchanger according to the first embodiment.
Figure 4:
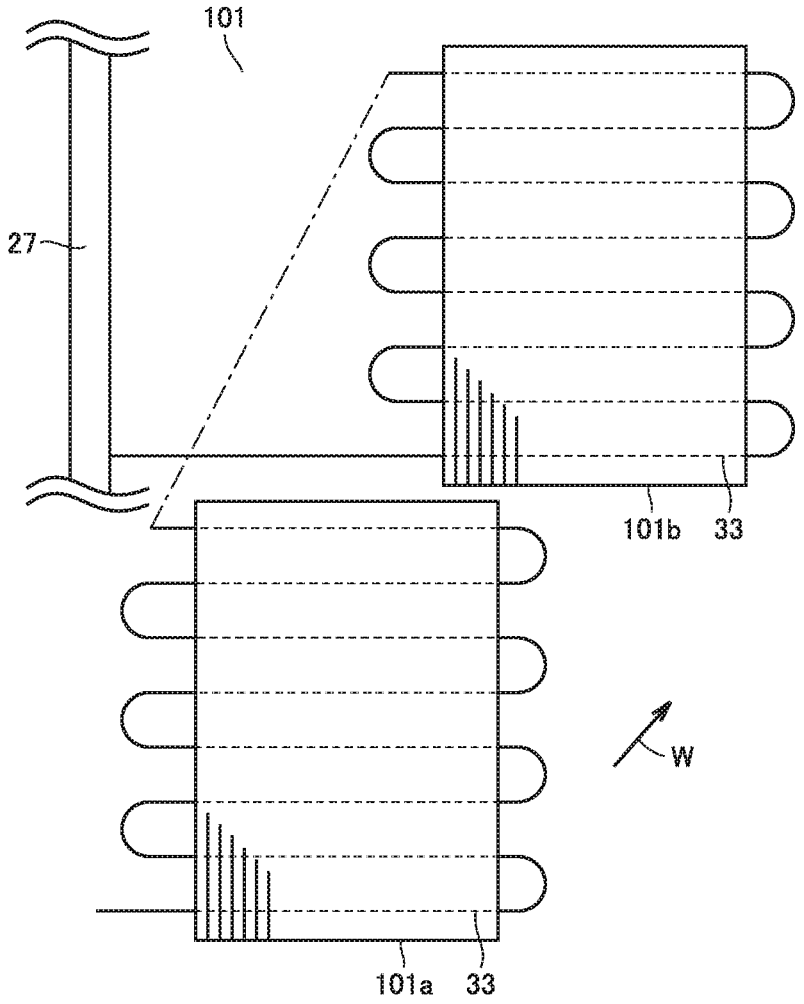
FIG. 4 is a schematic front view showing the main heat exchange area of the outdoor heat exchanger according to the first embodiment.
Figure 5:
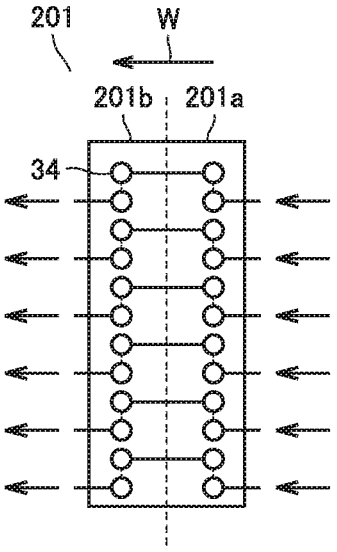
FIG. 5 is a schematic side view showing a sub heat exchange area of the outdoor heat exchanger according to the first embodiment.
Figure 6:
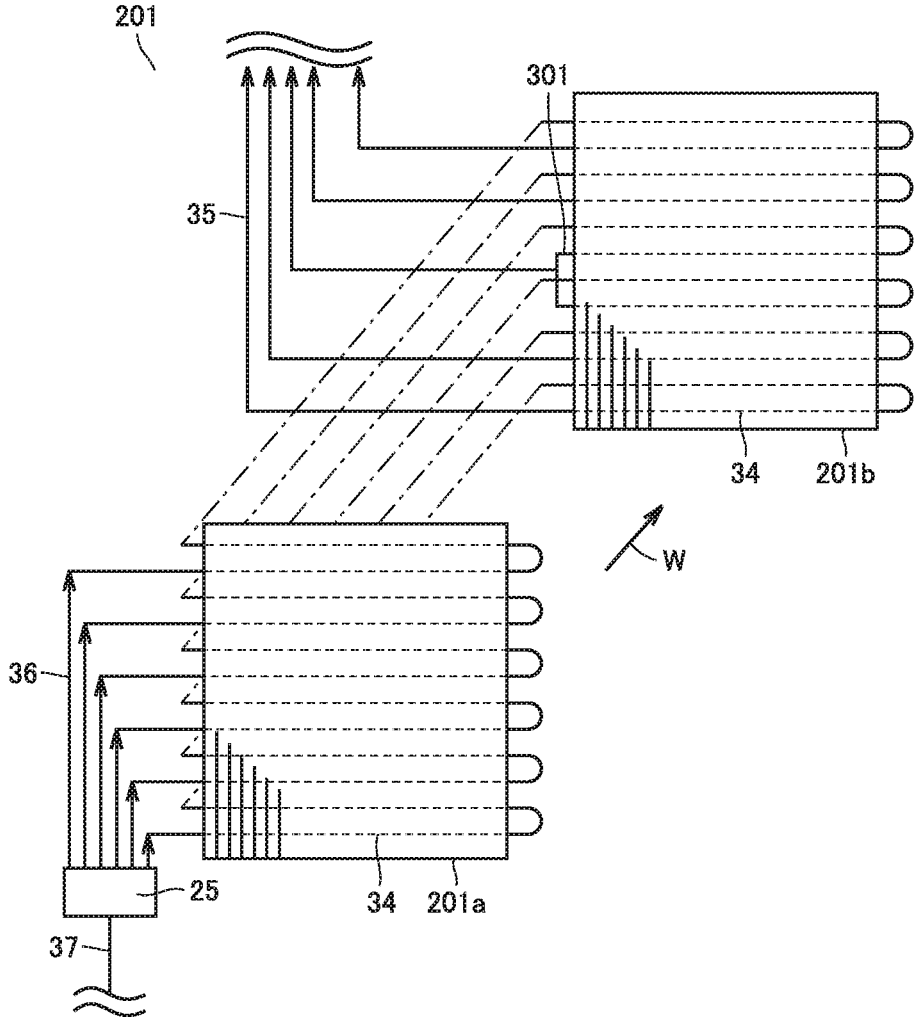
FIG. 6 is a schematic front view showing the sub heat exchange area of the outdoor heat exchanger according to the first embodiment.
Figure 7:
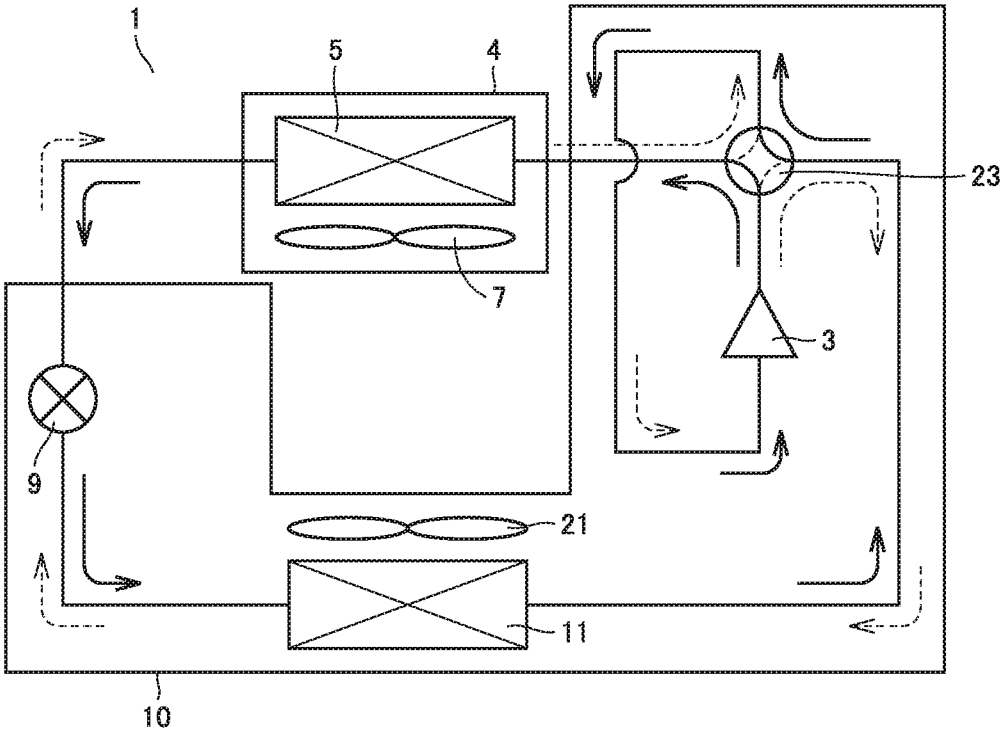
FIG. 7 is a diagram showing how refrigerant flows through the refrigerant circuit for illustrating how the air conditioner according to the first embodiment operates.

FIGS. 3 and 4 show a configuration of main heat exchange area 101 in detail. FIGS. 5 and 6 show a configuration of sub heat exchange area 201 in detail. In FIGS. 3 to 6, an arrow W indicates a flow of wind. As shown in FIGS. 3 and 4, in main heat exchange area 101, a plurality of heat transfer tubes 33 form a plurality of refrigerant paths. As shown in FIGS. 5 and 6, in sub heat exchange area 201, a plurality of heat transfer tubes 34 form a plurality of refrigerant paths. The plurality of refrigerant paths have some refrigerant paths joined by joining path 301 at the outlet of sub heat exchange area 201 (or on the side of sub heat exchange area 201*b*).

Referring again to FIG. 2, one end side of main heat exchange area 101 (the side of main heat exchange area 101*a*) and the other end side of sub heat exchange area 201 (the side of sub heat exchange area 201*b*) are connected by the plurality of connecting pipes 35. In the present embodiment, the plurality of connecting pipes 35A to 35E interconnect main heat exchange area 101 and sub heat exchange area 201. Connecting pipe 35A connects main heat exchange channel 33A and sub heat exchange channel 34A. Connecting pipe 35B connects main heat exchange channel 33B and sub heat exchange channel 34B. Connecting pipe 35C connects main heat exchange channel 33C and sub heat exchange channels 34C and 34D. Connecting pipe 35C connects sub heat exchange channels 34C and 34D to main heat exchange channel 33C while sub heat exchange channels 34C and 34D are joined together. Connecting pipe 35D connects main heat exchange channel 33D and sub heat exchange channel 34E. Connecting pipe 35E connects main heat exchange channel 33E and sub heat exchange channel 34F.

In the present embodiment, connecting pipe 35C corresponds to the claimed first connecting pipe. Any of connecting pipes 35A, 35B, 35D, and 35E corresponds to the claimed second connecting pipe. Main heat exchange channel 33C corresponds to the claimed first main heat exchange channel. Any of main heat exchange channels 33A, 33B, 33D, and 33E corresponds to the claimed second main heat exchange channel. Sub heat exchange channels 34C and 34D correspond to the claimed first and second sub heat exchange channels. Any of sub heat exchange channels 34A, 34B, 34E, and 34F corresponds to the claimed third sub heat exchange channel.

Main heat exchange area 101 has the other end side (or the side of main heat exchange area 101*b*) connected to a header 27. Sub heat exchange area 201 has the refrigerant paths with one end side (or the side of sub heat exchange area 201*a*) connected to a distributor 25 by a connecting pipe 36. A connecting pipe 37 is connected to distributor 25.

Reference will be made to FIGS. 2 to 7 to describe how air conditioner 1 of the present embodiment operates. In the figures, a dotted line arrow indicates a flow of refrigerant during the cooling operation, and a solid line arrow indicates a flow of refrigerant during the heating operation.

Initially, the cooling operation will be described. As compressor 3 is driven, compressor 3 discharges refrigerant in a high-temperature and high-pressure gaseous state. The discharged high-temperature and high-pressure gas refrigerant (of a single-phase) flows into outdoor heat exchanger 11 of outdoor unit 10 via four-way valve 23. Outdoor heat exchanger 11 exchanges heat between the refrigerant flowing thereinto and external air (air) supplied by outdoor blower 21 as fluid. As a result, the high-temperature and high-pressure gas refrigerant is condensed into a high-pressure liquid refrigerant (of a single phase).

Outdoor heat exchanger 11 sends out the high-pressure liquid refrigerant which in turn becomes a two-phase refrigerant of a low-pressure gas refrigerant and a liquid refrigerant through throttling device 9. The two-phase refrigerant flows into indoor heat exchanger 5 of indoor unit 4. Indoor heat exchanger 5 exchanges heat between the two-phase refrigerant flowing thereinto and air supplied by indoor blower 7. As a result, the two-phase refrigerant has the liquid refrigerant evaporated therefrom and thus becomes a low-pressure gas refrigerant (of a single phase). Thus exchanging heat cools an interior of a room. Indoor heat exchanger 5 sends out the low-pressure gas refrigerant which in turn flows via four-way valve 23 into compressor 3 and is compressed therein into a high-temperature and high-pressure gas refrigerant and is again discharged from compressor 3. Thereafter, this cycle is repeated.

Hereinafter, how the refrigerant flows in outdoor heat exchanger 11 during the cooling operation will be described in detail. In the cooling operation, outdoor heat exchanger 11 operates as a condenser. Outdoor heat exchanger 11 receives the refrigerant sent from compressor 3 and passes the refrigerant through main heat exchange area 101 followed by sub heat exchange area 201. Specifically, compressor 3 sends a high-temperature and high-pressure gas refrigerant, which initially flows into header 27. Header 27 receives and distributes the refrigerant which in turn flows in main heat exchange areas 101*a* and 101*b* through each main heat exchange channel (or refrigerant path) 33A to 33E. Main heat exchange areas 101*a* and 101*b* thus pass the refrigerant which in turn flows through the plurality of connecting pipes 35 to sub heat exchange areas 201*b* and 201*a*. Sub heat exchange areas 201*b* and 201*a* pass the refrigerant which in turn flows through connecting pipe 36 into distributor 25 and is joined therein. The refrigerant joined in distributor 25 flows out through connecting pipe 37.

Main heat exchange area 101 and sub heat exchange area 201 receive air blown by outdoor blower 21, and the air flows from main heat exchange area 101*a* and sub heat exchange area 201*a* in the first row (or on the windward side) toward main heat exchange area 101*b* and sub heat exchange area 201*b* in the second row (or the leeward side).

Hereinafter, the heating operation will be described. As compressor 3 is driven, compressor 3 discharges refrigerant in a high-temperature and high-pressure gaseous state. The discharged high-temperature and high-pressure gas refrigerant (of a single-phase) flows into indoor heat exchanger 5 via four-way valve 23. Indoor heat exchanger 5 exchanges heat between the gas refrigerant flowing thereinto and air supplied by indoor blower 7. As a result, the high-temperature and high-pressure gas refrigerant is condensed into a high-pressure liquid refrigerant (of a single phase) Thus exchanging heat warms an interior of a room. Indoor heat exchanger 5 sends the high-pressure liquid refrigerant which in turn becomes a two-phase refrigerant of a low-pressure gas refrigerant and a liquid refrigerant through throttling device 9. The two-phase refrigerant flows into outdoor heat exchanger 11 of outdoor unit 10. Outdoor heat exchanger 11 exchanges heat between the two-phase refrigerant flowing thereinto and air supplied by outdoor blower 21. As a result, the two-phase refrigerant has the liquid refrigerant evaporated therefrom and thus becomes a low-pressure gas refrigerant (of a single phase). Outdoor heat exchanger 11 sends out the low-pressure gas refrigerant which in turn flows via four-way valve 23 into compressor 3 and is compressed therein into a high-temperature and high-pressure gas refrigerant and again discharged from compressor 3. Thereafter, this cycle is repeated.

Hereinafter, how the refrigerant flows in outdoor heat exchanger 11 during the heating operation will be described in detail. In the heating operation, outdoor heat exchanger 11 operates as an evaporator. Outdoor heat exchanger 11 receives refrigerant sent from throttling device 9 and passes the refrigerant through sub heat exchange area 201 followed by main heat exchange area 101. Specifically, a two-phase refrigerant sent from indoor heat exchanger 5 via throttling device 9 initially flows into distributor 25. Distributor 25 receives the refrigerant, which in turn flows in sub heat exchange areas 201*a* and 201*b* through the each sub heat exchange channel (or refrigerant path) 34A to 34F. Sub heat exchange areas 201*a* and 201*b* thus pass the refrigerant, which in turn flows through connecting pipe 35 into main heat exchange areas 101*a* and 101*b*. Main heat exchange areas 101*a* and 101*b* receive the refrigerant, which in turn flows into header 27 and joins in header 27. The refrigerant is sent out of outdoor heat exchanger 11 via header 27.

Main heat exchange area 101 and sub heat exchange area 201 receive air blown by outdoor blower 21, and the air flows from main heat exchange area 101*a* and sub heat exchange area 201*a* in the first row (or on the windward side) toward main heat exchange area 101*b* and sub heat exchange area 201*b* in the second row (or the leeward side).

As has been set forth above, during the heating operation, heat is exchanged between external air sent into outdoor unit 10 by outdoor blower 21 and refrigerant sent to outdoor heat exchanger 11. When this heat exchange is performed, moisture in the external air (or air) is condensed and water droplets are grown on a surface of outdoor heat exchanger 11. That is, dew condensation occurs on the surface of outdoor heat exchanger 11. The grown water droplets flow in the gravitational direction through a drainage channel of outdoor heat exchanger 11 configured by fin 31 and heat transfer tube 33 and are discharged as drained water.

Hereinafter, a function and effect of the present embodiment will be described. According to the present embodiment, outdoor heat exchanger 11 has connecting pipe 35C to connect sub heat exchange channels 34C and 34D to main heat exchange channel 33C while sub heat exchange channels 34C and 34D are joined together. Thus connecting pipe 35C connects sub heat exchange channels 34C and 34D to main heat exchange channel 33C without re-branching sub heat exchange channels 34C and 34D. This can suppress an increase in pressure loss inside connecting pipe 35C. Furthermore, connecting pipe 35C and connecting pipes 35A, 35B, 35D, 35E interconnect main heat exchange area 101 and sub heat exchange area 201. Thus, sub heat exchange area 201 does not have its paths all integrated into a single connecting pipe 35. This allows refrigerant's flow rate to be divided into connecting pipe 35C and connecting pipes 35A, 35B, 35D, 35E and can thus suppress an increase in pressure loss inside connecting pipe 35C and connecting pipes 35A, 35B, 35D, 35E. This can suppress deterioration in performance as a heat exchanger.

Furthermore, connecting pipe 35C connects sub heat exchange channels 34C and 34D to main heat exchange channel 33C while sub heat exchange channels 34C and 34D are joined together. Therefore, even if one of sub heat exchange channels 34C and 34D poorly passes refrigerant, it can be joined to that flowing through the other one of sub heat exchange channels 34C and 34D to help to level the refrigerant's flow rate in sub heat exchange channels 34C and 34D. This can suppress deviation in flow rate of refrigerant flowing toward main heat exchange area 101.

According the present embodiment, outdoor unit 10 includes outdoor heat exchanger 11 as described above, and can thus suppress deterioration in performance as a heat exchanger due to an increase in pressure loss.

According to the present embodiment, air conditioner 1 includes the outdoor unit as described above, and can thus suppress deterioration in performance as a heat exchanger due to an increase in pressure loss.

Second Embodiment

In each of the following embodiments, any configuration identical to that in the first embodiment is identically denoted and will not be described repeatedly unless otherwise specified.

Outdoor heat exchanger 11 according to a second embodiment of the present invention will be described with reference to FIGS. 8 to 10.

Figure 8:
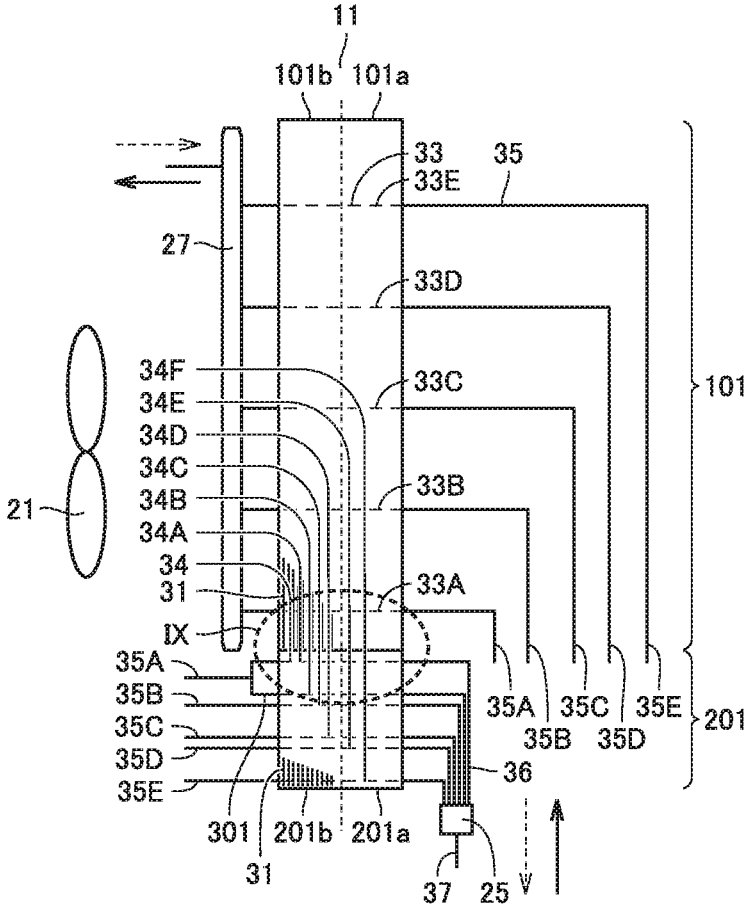
FIG. 8 is a schematic diagram showing an outdoor heat exchanger according to a second embodiment.
Figure 9:
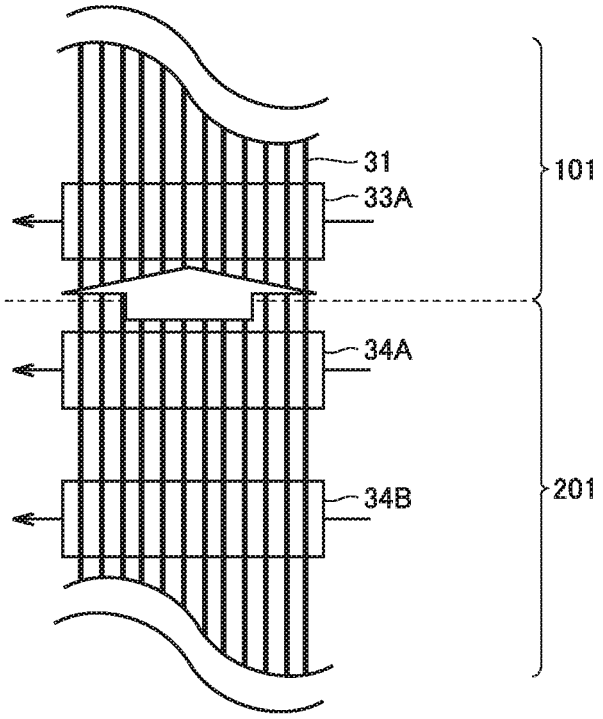
FIG. 9 is an enlarged view of a portion IX shown in FIG. 8 for illustrating an effect of heat conduction loss.

As shown in FIGS. 8 and 9, in the present embodiment, main heat exchange area 101 and sub heat exchange area 201 are disposed adjacent to each other. Main heat exchange area 101 and sub heat exchange area 201 are vertically aligned. Main heat exchange area 101 and sub heat exchange area 201 may be configured to be in contact with each other. Furthermore, main heat exchange area 101 and sub heat exchange area 201 may be integrally configured. In the present embodiment, main heat exchange channel 33A is disposed at a position closest to sub heat exchange area 201. That is, main heat exchange channel 33A is disposed at the lowermost stage of main heat exchange channels 33A to 33E disposed vertically in main heat exchange area 101. Sub heat exchange channel 34A is disposed at a position closest to main heat exchange area 101. That is, sub heat exchange channel 34A is disposed in the uppermost stage of sub heat exchange channels 34A to 34F disposed vertically in sub heat exchange area 201.

Joining path 301 is configured to join sub heat exchange channel 34A adjacent to main heat exchange area 101 and another sub heat exchange channel (for example, sub heat exchange channel 34B) together. That is, in the present embodiment, joining path 301 joins together sub heat exchange channel 34A and sub heat exchange channel 34B adjacent thereto. It should be noted that joining path 301 may include sub heat exchange channel 34A and join it with any of the other sub heat exchange channels 34B to 34F.

In the present embodiment, connecting pipe 35A corresponds to the claimed first connecting pipe. Any of connecting pipes 35B to 35E corresponds to the claimed second connecting pipe. Main heat exchange channel 33A corresponds to the claimed first main heat exchange channel. Any of main heat exchange channels 33B to 33E corresponds to the claimed second main heat exchange channel. Sub heat exchange channels 34A and 34B correspond to the claimed first and second sub heat exchange channels. Any of sub heat exchange channels 34C to 34F corresponds to the third sub heat exchange channel.

In sub heat exchange channel 34A adjacent to main heat exchange area 101, when refrigerant flows from sub heat exchange area 201 to main heat exchange area 101, the refrigerant's temperature decreases due to an effect of an intra-tube pressure loss. And heat is transferred from refrigerant of high temperature to refrigerant of low temperature via fins 31 and heat transfer tubes 33. That is, heat conduction loss occurs. Therefore, the refrigerant flowing in sub heat exchange area 201 through sub heat exchange channel 34A adjacent to main heat exchange area 101 is lower in dryness than that flowing in sub heat exchange area 201 through sub heat exchange channel 34B.

Figure 10:
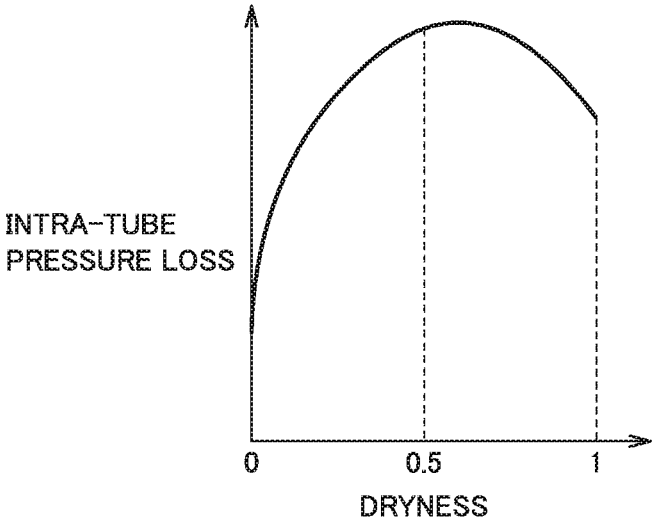
FIG. 10 is a schematic diagram showing a relationship between intra-tube pressure loss and dryness.

As shown in FIG. 10, in a range in which intra-tube pressure loss increases as dryness increases from 0 to 1, intra-tube pressure loss tends to decrease as dryness decreases. Therefore, the refrigerant more easily flows through sub heat exchange channel 34A than sub heat exchange channel 34B. Therefore, the refrigerant flows through sub heat exchange channel 34A into main heat exchange area 101 at a larger flow rate than through sub heat exchange channel 34B into main heat exchange area 101. In order to address this, joining path 301 is configured to join sub heat exchange channel 34A adjacent to main heat exchange area 101 and sub heat exchange channel 34B together at the outlet of sub heat exchange area 201 and thus suppress deviation in flow rate of refrigerant.

According to the present embodiment, outdoor heat exchanger 11 has sub heat exchange channel 34A disposed at a position closest to main heat exchange area 101. Sub heat exchange channel 34A passing refrigerant at an increased flow rate and sub heat exchange channel 34B passing refrigerant at a smaller flow rate than sub heat exchange channel 34A are joined together, and deviation in flow rate of refrigerant can be suppressed.

Furthermore, when deviation in flow rate of refrigerant flowing into main heat exchange area 101 is leveled, one of the paths forming joining path 301, or sub heat exchange channel 34A, passes refrigerant at a reduced flow rate, resulting in a reduced intra-tube pressure loss. When this is compared with not providing joining path 301 at a position adjacent to main heat exchange area 101, the former less reduces the refrigerant's temperature and can thus reduce heat conduction loss.

Third Embodiment

Figure 11:
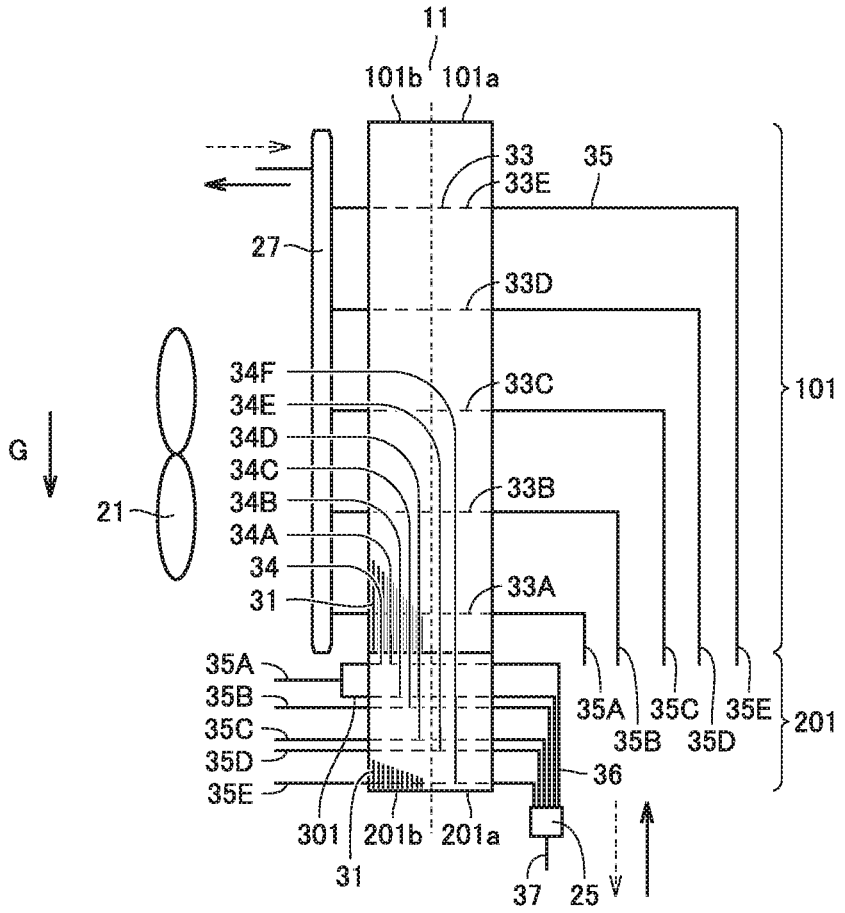
FIG. 11 is a schematic diagram showing an outdoor heat exchanger according to a third embodiment.

Outdoor heat exchanger 11 according to a third embodiment of the present invention will be described with reference to FIG. 11. In the present embodiment, sub heat exchange channels 34A and 34B are aligned in the gravitational direction. In the present embodiment, sub heat exchange channels 34A to 34F are aligned in the gravitational direction. Joining path 301 joins together sub heat exchange channels 34A and 34B aligned in the gravitational direction.

In the present embodiment, connecting pipe 35A corresponds to the claimed first connecting pipe. Any of connecting pipes 35B to 35E corresponds to the claimed second connecting pipe. Main heat exchange channel 33A corresponds to the claimed first main heat exchange channel. Any of main heat exchange channels 33B to 33E corresponds to the claimed second main heat exchange channel. Sub heat exchange channels 34A and 34B correspond to the claimed first and second sub heat exchange channels. Any of sub heat exchange channels 34C to 34F corresponds to the third sub heat exchange channel.

In outdoor heat exchanger 11, an amount of condensed water increases in the gravitational direction G when the heating operation is performed. Therefore, the lower the gravitational direction G is, the more difficult it is for air to pass due to condensed water, and heat exchange is prevented and dryness is reduced. As shown in FIG. 10, intra-tube pressure loss is smaller for lower dryness. As a result, for a lower side in the gravitational direction G, intra-tube pressure loss decreases and refrigerant flows at an increased flow rate. Therefore, main heat exchange area 101 receives refrigerant flowing thereinto at a flow rate with an increased deviation.

According to the present embodiment, outdoor heat exchanger 11 has sub heat exchange channels 34A and 34B aligned in the gravitational direction G. Sub heat exchange channel 34A and sub heat exchange channel 34B passing refrigerant at a larger flow rate than sub heat exchange channel 34A are joined together, and deviation in flow rate of refrigerant can be suppressed.

Subsequently, with reference to FIGS. 12 and 13, outdoor heat exchanger 11 according to a modification of the third embodiment of the present invention will be described. In the modification of the present embodiment, sub heat exchange channel 34F is disposed at a lowermost position in sub heat exchange area 201. Joining path 301 is configured to join sub heat exchange channel 34F disposed at the lowermost stage of sub heat exchange area 201 and another sub heat exchange channel (for example, sub heat exchange channel 34E) together.

In the modification of the present embodiment, connecting pipe 35E corresponds to the claimed first connecting pipe. Any of connecting pipes 35A to 35D corresponds to the claimed second connecting pipe. Main heat exchange channel 33E corresponds to the claimed first main heat exchange channel. Any of main heat exchange channels 33A to 33D corresponds to the claimed second main heat exchange channel. Sub heat exchange channels 34F and 34E correspond to the claimed first and second sub heat exchange channels. Any of sub heat exchange channels 34A to 34D corresponds to the third sub heat exchange channel.

Figure 12:
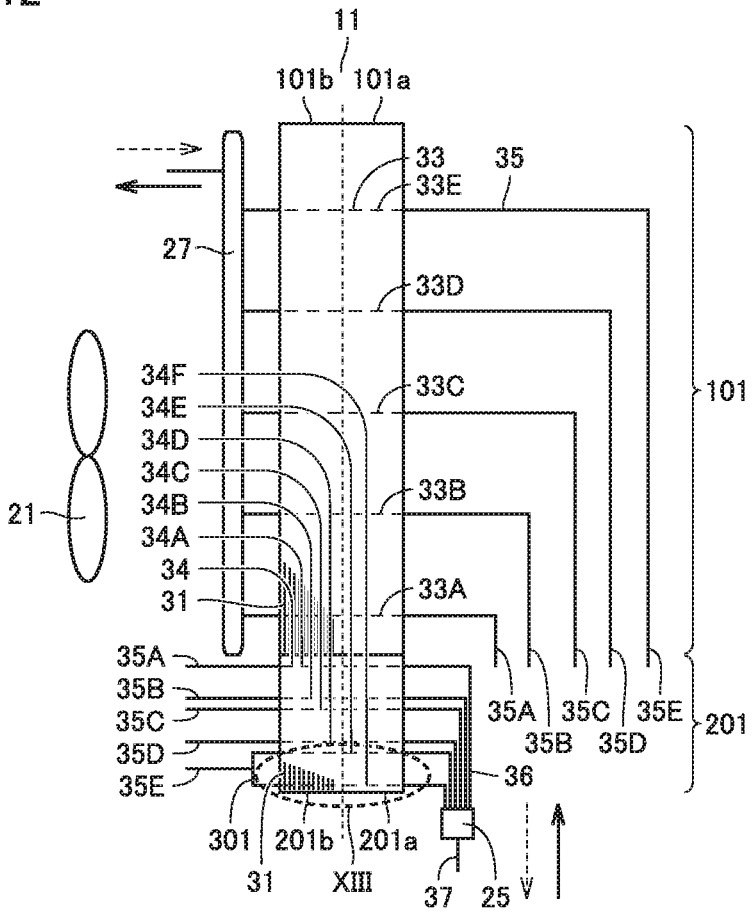
FIG. 12 is a schematic diagram showing an outdoor heat exchanger according to a modification of the third embodiment.
Figure 13:
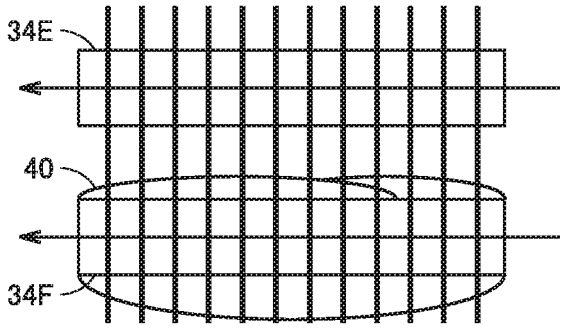
FIG. 13 is an enlarged view of a portion XIII shown in FIG. 12 for illustrating an effect of condensed water retention.

As shown in FIGS. 12 and 13, at sub heat exchange channel 34F located at the lowermost stage, condensed water 40 stagnates, and air is less likely to pass. This prevents sub heat exchange channel 34F from exchanging heat. Therefore, sub heat exchange channel 34F is smaller in dryness than sub heat exchange channel 34E. As shown in FIG. 10, intra-tube pressure loss is smaller for lower dryness. Therefore, the lowermost sub heat exchange channel 34F has small intra-tube pressure loss and accordingly, passes refrigerant at an increased flow rate. Therefore, main heat exchange area 101 receives refrigerant flowing thereinto at a flow rate with an increased deviation.

In outdoor heat exchanger 11 according to the modification of the present embodiment, joining path 301 set at the outlet of sub heat exchange area 201 is configured to join together the lowermost sub heat exchange channel 34F and sub heat exchange channel 34E of sub heat exchange area 201. This suppresses deviation in flow rate of refrigerant.

According to the modification of the present embodiment, outdoor heat exchanger 11 has sub heat exchange channel 34F disposed at a lowermost position in sub heat exchange area 201. Sub heat exchange channel 34F passing refrigerant at an increased flow rate and sub heat exchange channel 34E passing refrigerant at a smaller flow rate than sub heat exchange channel 34F are joined together, and deviation in flow rate of refrigerant can further be suppressed.

Fourth Embodiment

Figure 14:
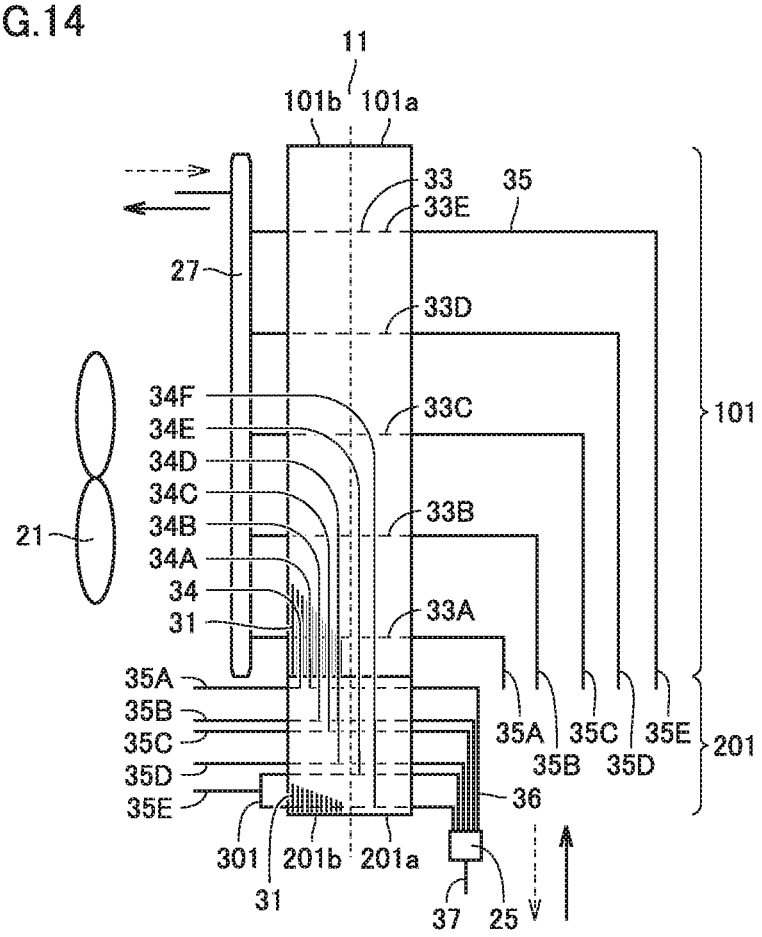
FIG. 14 is a schematic diagram showing an outdoor heat exchanger according to a fourth embodiment.

Outdoor heat exchanger 11 according to a fourth embodiment of the present invention will be described with reference to FIG. 14. In the present embodiment, sub heat exchange channel 34F is disposed in sub heat exchange area 201 at a position farthest from outdoor blower (a blower) 21. Joining path 301 is configured to join sub heat exchange channel 34F of sub heat exchange area 201 having a longest distance from outdoor blower 21 and another sub heat exchange channel (for example, sub heat exchange channel 34E) together.

In the present embodiment, connecting pipe 35E corresponds to the claimed first connecting pipe. Any of connecting pipes 35A to 35D corresponds to the claimed second connecting pipe. Main heat exchange channel 33E corresponds to the claimed first main heat exchange channel. Any of main heat exchange channels 33A to 33D corresponds to the claimed second main heat exchange channel. Sub heat exchange channels 34F and 34E correspond to the claimed first and second sub heat exchange channels. Any of sub heat exchange channels 34A to 34D corresponds to the third sub heat exchange channel.

A refrigerant path that is far in distance from outdoor blower 21 is difficult to exchange heat and hence passes refrigerant into main heat exchange area 101 at an increased flow rate. In order to solve this, joining path 301 is configured to join sub heat exchange channel 34F having a longest distance from outdoor blower 21 and another sub heat exchange channel (for example, sub heat exchange channel 34E) together. This suppresses deviation in flow rate of refrigerant flowing into main heat exchange area 101.

According to the present embodiment, outdoor heat exchanger 11 has sub heat exchange channel 34F disposed in sub heat exchange area 201 at a position farthest from outdoor blower 21. Sub heat exchange channel 34F passing refrigerant at an increased flow rate and sub heat exchange channel 34E passing refrigerant at a smaller flow rate than sub heat exchange channel 34F are joined together, and deviation in flow rate of refrigerant can be suppressed.

Fifth Embodiment

Figure 15:
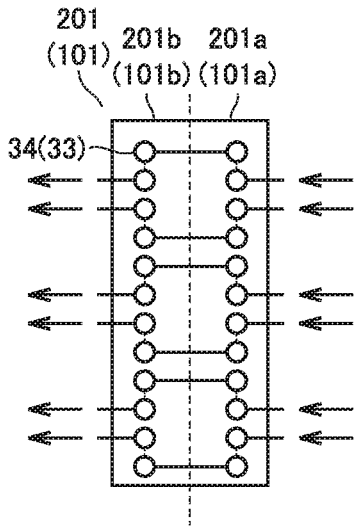
FIG. 15 is a schematic side view showing a main heat exchange area of an outdoor heat exchanger according to a fifth embodiment.
Figure 16:
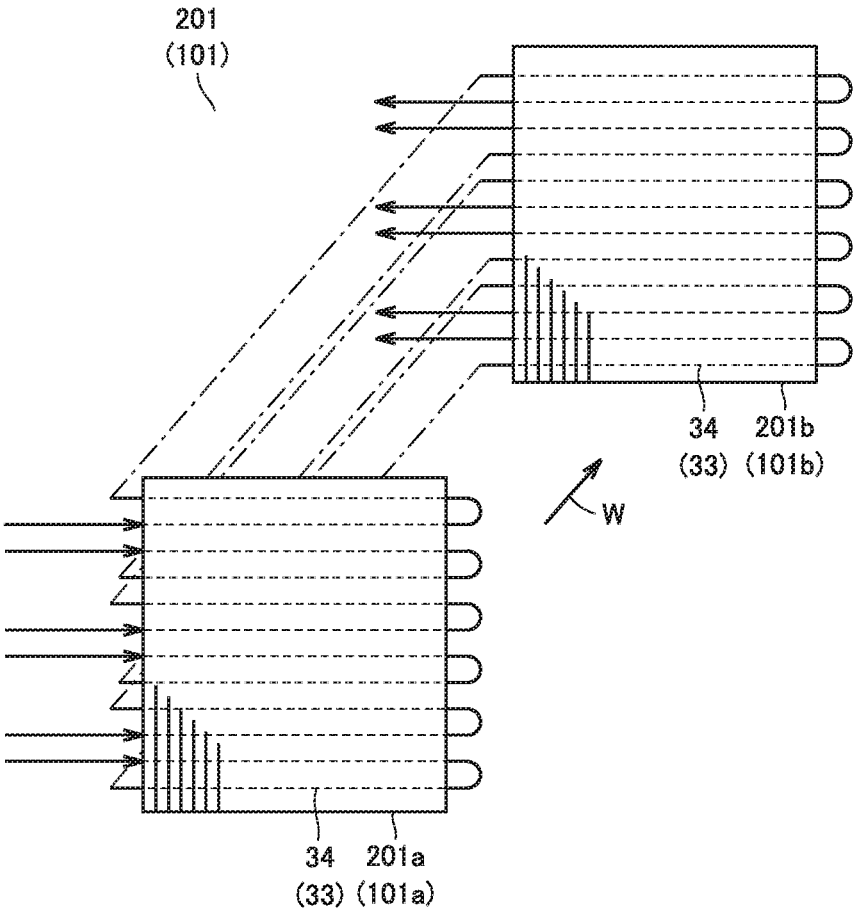
FIG. 16 is a schematic front view showing the main heat exchange area of the outdoor heat exchanger according to the fifth embodiment.

Outdoor heat exchanger 11 according to a fifth embodiment of the present invention will be described with reference to FIGS. 15 and 16. In the present embodiment, refrigerant paths equivalent in length are provided. The present embodiment is not limited to a path configuration of sub heat exchange area 201 and is also applicable to main heat exchange area 101. Herein, sub heat exchange area 201 will be described as an example. In the present embodiment, sub heat exchange channels 34A and 34B are equal in length. Note herein that being equivalent means being the same within a manufacturing error range. Furthermore, sub heat exchange channels 34A and 34B have their respective inlets adjacently. Sub heat exchange channels 34A and 34B have their respective outlets adjacently.

The heat conduction loss described above does not occur only between main heat exchange area 101 and an adjacent sub heat exchange channel of sub heat exchange area 201 (i.e., between main heat exchange channel 34A and sub heat exchange channel 34A), and it occurs if there is a difference in temperature of refrigerant between adjacent sub heat exchange channels. This reduces efficiency of exchanging heat between refrigerant and air.

In order to solve this, at least one set of sub heat exchange channels 34A and 34B of sub heat exchange area 201 that are joined at joining path 301 have their respective refrigerant channels configured to be equivalent in length and also have their respective inlets adjacently and their respective outlets adjacently.

According to the present embodiment, outdoor heat exchanger 11 has sub heat exchange channels 34A and 34B equal in length. And sub heat exchange channels 34A and 34B have their respective inlets adjacently and their respective outlets adjacently. As a result, heat conduction loss occurs at a portion which is halved structurally, and efficiency of exchanging heat is increased.

Furthermore, for example, when sub heat exchange channels 34A and 34B are connected by a three-way pipe or the like, close refrigerant inflow and outflow positions allow the three-way pipe to be reduced in size. This contributes to reduction in cost for material.

Sixth Embodiment

Figure 17:
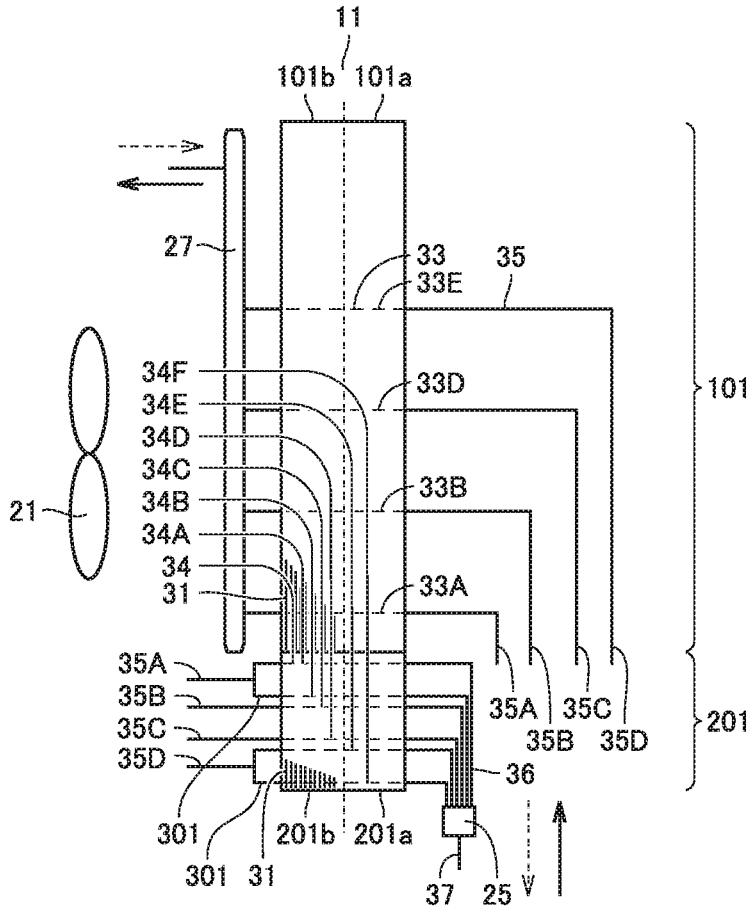
FIG. 17 is a schematic diagram showing an outdoor heat exchanger according to a sixth embodiment.

Outdoor heat exchanger 11 according to a sixth embodiment of the present invention will be described with reference to FIG. 17. In the present embodiment, a plurality of joining paths 301 are provided. In the present embodiment, two joining paths 301 are provided. Sub heat exchange channels 34A and 34B are joined together by one joining path 301. Connecting pipe 35A connects sub heat exchange channels 34A and 34B to main heat exchange channel 33A while sub heat exchange channels 34A and 34B are joined together. Furthermore, sub heat exchange channels 34E and 34F are joined together by the other joining path 301. Connecting pipe 35D connects sub heat exchange channels 34E and 34F to main heat exchange channel 33E while sub heat exchange channels 34E and 34F are joined together.

One of two joining paths 301 is configured to join sub heat exchange channel 34A adjacent to main heat exchange area 101 and another sub heat exchange channel (for example, sub heat exchange channel 34B) together. The other of two joining paths 301 is configured to join sub heat exchange channel 34F disposed at the lowermost stage of sub heat exchange area 201 and another sub heat exchange channel (for example, sub heat exchange channel 34E) together. That is, the other joining path 301 is disposed at the lowermost stage of outdoor heat exchanger 11.

According to the present embodiment, outdoor heat exchanger 11 has connecting pipe 35A to connect sub heat exchange channels 34A and 34B to main heat exchange channel 33A without re-branching sub heat exchange channels 34A and 34B. Furthermore, connecting pipe 35D connects sub heat exchange channels 34E and 34F to main heat exchange channel 33E while sub heat exchange channels 34E and 34F are joined together. This can effectively suppress an increase in pressure loss inside connecting pipes 35A and 35D. This can effectively suppress deterioration in performance as a heat exchanger.

Furthermore, sub heat exchange channel 34A is disposed at a position closest to main heat exchange area 101. Furthermore, sub heat exchange channel 34F is disposed at a lowermost position in sub heat exchange area 201. This can effectively suppress deviation in flow rate of refrigerant.

Seventh Embodiment

Figure 18:
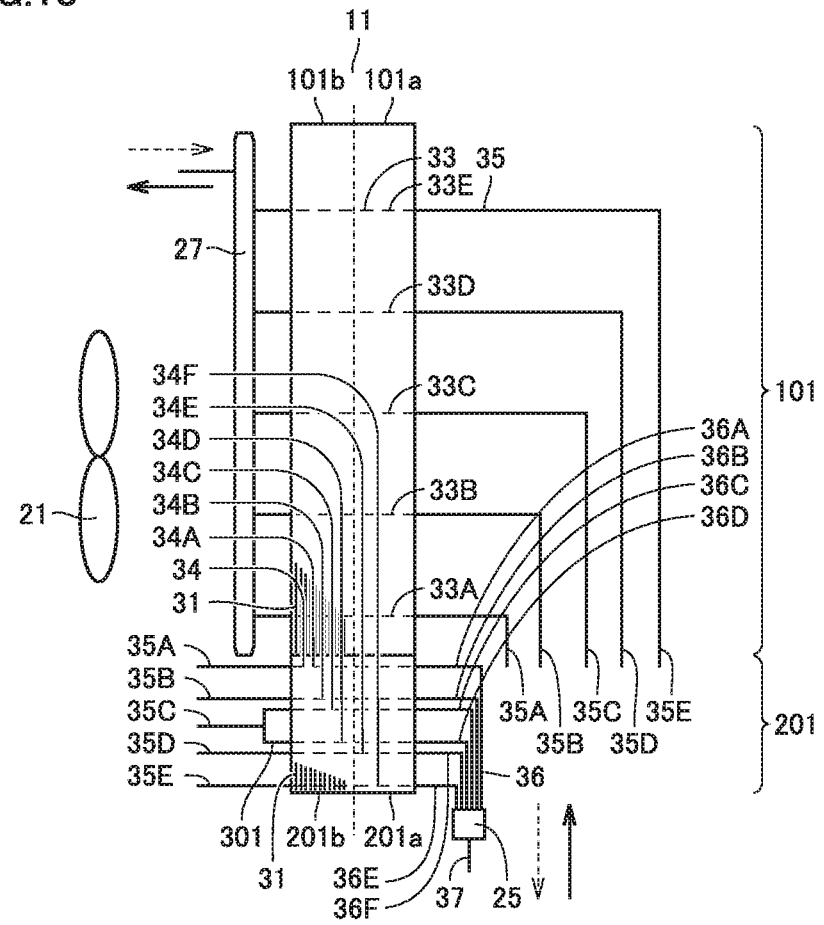
FIG. 18 is a schematic diagram showing an outdoor heat exchanger according to a seventh embodiment.

Outdoor heat exchanger 11 according to a seventh embodiment of the present invention will be described with reference to FIG. 18. External air passes through outdoor heat exchanger 11 at a wind velocity, which has a distribution depending on a positional relationship with outdoor blower 21. Due to this wind velocity distribution, an amount of heat that can be exchanged vary for each refrigerant path in main heat exchange area 101. Therefore, adjusting refrigerant in flow rate in accordance with the amount of heat that can be exchanged can increase efficiency of exchanging heat. Furthermore, joining a refrigerant path that is joined by joining path 301 at the inlet of sub heat exchange area 201 and connecting the refrigerant path to distributor 25 helps adjusting refrigerant in flow rate.

To adjust refrigerant in flow rate, connecting pipe 36 is changed in dimension. Specifically, connecting pipe 36 is changed in dimension so that a refrigerant path exposed to air at a large wind velocity passes refrigerant at an increased flow rate and a refrigerant path exposed to air at a small wind velocity passes refrigerant at a reduced flow rate. More specifically, connecting pipe 36 is changed in length, inner diameter and the like, and connecting pipe 36 for the path with high wind velocity and connecting pipe 36 for the path with low wind velocity have a resistance coefficient Cv1 and a resistance coefficient Cv2, respectively, in a relationship of Cv1<Cv2.

Eighth Embodiment

Figure 19:
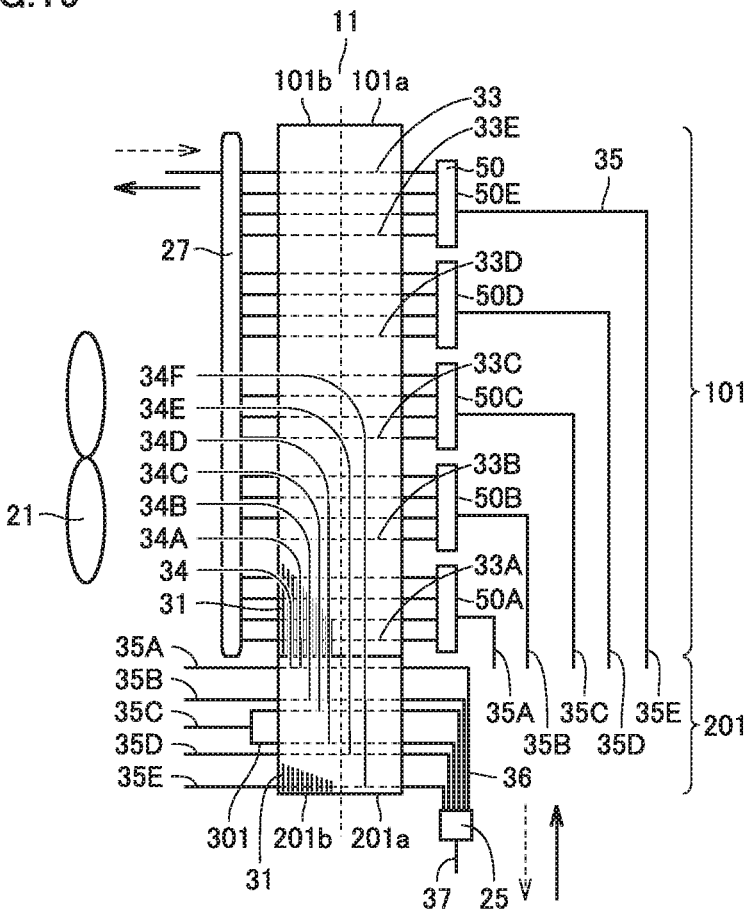
FIG. 19 is a schematic diagram showing an outdoor heat exchanger according to an eighth embodiment.

With reference to FIG. 19, outdoor heat exchanger 11 of an outdoor unit according to an eighth embodiment will be described. In the present embodiment, main heat exchange area 101 has a plurality of distribution units 50. In the present embodiment, main heat exchange area 101 has distributors 50A to 50E. Distributors 50A to 50E may have the same shape. The same shape means that the same shape within a manufacturing error range. Distribution units 50A to 50E are connected to main heat exchange channels 33A to 33E, respectively. Connecting pipes 35A to 35E are connected to distribution units 50A to 50E, respectively.

In the present embodiment, a flat multi-hole tube may be adopted as heat transfer tube 33. When the flat multi-hole tube is compared with a circular tube, the former provides larger intra-tube pressure loss. In order to reduce this intra-tube pressure loss, the number of heat transfer tubes 33 forming a single path is reduced to provide multiple paths. Providing multiple paths increases the number by which refrigerant is distributed. Accordingly, distributor 50 may be provided for each path group of main heat exchange area 101.

In the present embodiment, connecting pipe 35C corresponds to the claimed first connecting pipe. Any of connecting pipes 35A, 35B, 35D, and 35E corresponds to the claimed second connecting pipe. Main heat exchange channel 33C corresponds to the claimed first main heat exchange channel. Any of main heat exchange channels 33A, 33B, 33D, and 33E corresponds to the claimed second main heat exchange channel. Sub heat exchange channels 34C and 34D correspond to the first and second sub heat exchange channels. Any of sub heat exchange channels 34A, 34B, 34E, and 34F corresponds to the third sub heat exchange channel. Distribution unit 50C corresponds to the claimed first distribution unit. Any of distribution units 50A, 50B, 50D, and 50E corresponds to the claimed second distribution unit.

According to the present embodiment, when outdoor heat exchanger 11 has a refrigerant path made to be multiple paths and thus a number by which refrigerant is distributed is increased, distribution unit 50 can be installed for each refrigerant path group of main heat exchange area 101 to adjust refrigerant in flow rate.

Ninth Embodiment

Figure 20:
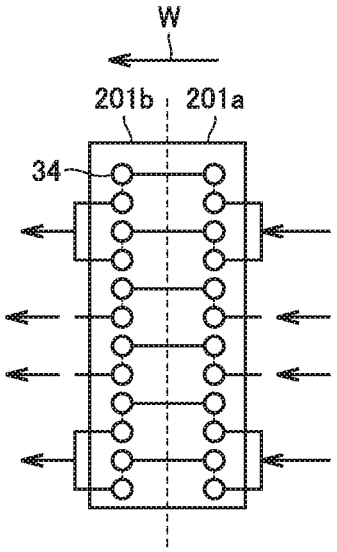
FIG. 20 is a schematic side view showing a main heat exchange area of an outdoor heat exchanger according to a ninth embodiment.
Figure 21:
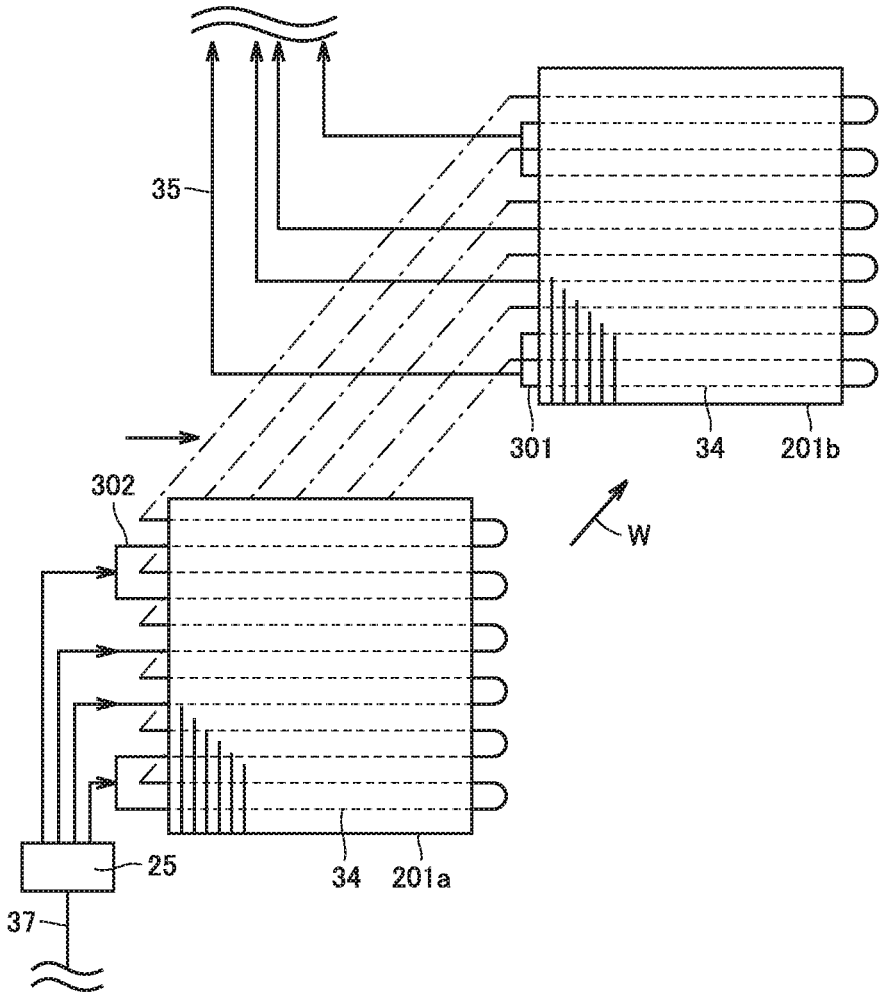
FIG. 21 is a schematic front view showing the main heat exchange area of the outdoor heat exchanger according to the ninth embodiment.

Outdoor heat exchanger 11 according to a ninth embodiment of the present invention will be described with reference to FIGS. 20 and 21. In the present embodiment, a joining path 302 is provided at the inlet of sub heat exchange area 201.

According to the present embodiment, outdoor heat exchanger 11 with joining path 302 can suppress deviation in flow rate of refrigerant flowing into sub heat exchange area 201.

As refrigerant used in air conditioner 1 according to each of the above-described embodiments, any refrigerant such as refrigerant R410A, refrigerant R407C, refrigerant R32, refrigerant R507A, and refrigerant HFO1234yf can be used to enhance performance as a heat exchanger when operating as an evaporator.

Furthermore, as a refrigerating machine oil used in air conditioner 1, a refrigerating machine oil having compatibility considering mutual solubility with refrigerant applied is used. For example, for a fluorocarbon refrigerant such as refrigerant R410A, an alkyl benzene oil-based, ester oil-based, or ether oil-based refrigerating machine oil is used. In addition to these, a mineral oil-based or fluorine oil-based refrigerating machine oil may be used.

For air conditioner 1 including outdoor heat exchanger 11 described in each embodiment, the configuration of each embodiment can be combined variously as needed.

It should be understood that the embodiments disclosed herein have been described for the purpose of illustration only and in a non-restrictive manner in any respect. The scope of the present invention is defined by the terms of the claims, rather than the description above, and is intended to include any modifications within the meaning and scope equivalent to the terms of the claims.

REFERENCE SIGNS LIST

1 air conditioner, 3 compressor, 4 indoor unit, 5 indoor heat exchanger, 7 indoor blower, 9 throttling device, 10 outdoor unit, 11 outdoor heat exchanger, 21 outdoor blower, 23 four-way valve, 25 distributor, 27 header, 31 fin, 33, 34 heat transfer tube, 33A to 33E main heat exchange channel, 34A to 34F sub heat exchange channel, 35, 36, 37 connecting pipe, 50 distribution unit, 101, 101*a*, 101*b* main heat exchange area, 201, 201*a*, 201*b* sub heat exchange area, 301, 302, joining path.

The invention claimed is:

1. A heat exchanger comprising:

a main heat exchange area;

a sub heat exchange area; and a first connecting pipe and a second connecting pipe interconnecting the main heat exchange area and the sub heat exchange area, wherein the main heat exchange area has a first main heat exchange channel and a second main heat exchange channel, the sub heat exchange area has a first sub heat exchange channel, a second sub heat exchange channel, and a third sub heat exchange channel, the first connecting pipe connects the first sub heat exchange channel and the second sub heat exchange channel to the first main heat exchange channel while the first sub heat exchange channel and the second sub heat exchange channel are joined together, the second connecting pipe connects the third sub heat exchange channel and the second main heat exchange channel together, and when the heat exchanger operates as an evaporator, refrigerant through the sub heat exchange area flows through the first connecting pipe into the main heat exchange area.

2. The heat exchanger according to claim 1, wherein the main heat exchange area and the sub heat exchange area are disposed adjacent to each other, and the first sub heat exchange channel is disposed at a position closest to the main heat exchange area.

3. The heat exchanger according to claim 1, wherein the first sub heat exchange channel and the second sub heat exchange channel are aligned in a gravitational direction.

4. The heat exchanger according to claim 1, wherein the first sub heat exchange channel is disposed at a lowermost position in the sub heat exchange area.

5. The heat exchanger according to claim 1, further comprising a blower configured to blow air to the sub heat exchange area, wherein the first sub heat exchange channel is disposed in the sub heat exchange area at a position farthest from the blower in the first sub heat exchange channel, the second sub heat exchange channel, and the third sub heat exchange channel.

6. The heat exchanger according to claim 1, wherein the first sub heat exchange channel and the second sub heat exchange channel are equal in length, the first sub heat exchange channel and the second sub heat exchange channel have inlets, respectively, adjacent to each other, and the first sub heat exchange channel and the second sub heat exchange channel have outlets, respectively, adjacent to each other.

7. The heat exchanger according to claim 1, wherein the main heat exchange area has a first distributor connected to the first main heat exchange channel and a second distributor connected to the second main heat exchange channel, the first connecting pipe is connected to the first distributor, and the second connecting pipe is connected to the second distributor.

8. An outdoor unit comprising the heat exchanger according to claim 1.

9. A refrigeration cycle apparatus comprising the outdoor unit according to claim 8.

* * * * *